US007780823B2

(12) United States Patent
Van Acker et al.

(10) Patent No.: US 7,780,823 B2
(45) Date of Patent: Aug. 24, 2010

(54) COMPACT SERVICE MODULE FOR USE IN ELECTROLYTIC ALUMINUM PRODUCTION PLANTS

(75) Inventors: Alain Van Acker, Orchies (FR); Patrick Delescluse, Cysoing (FR); Benoit Morel, Sailly-Lez-Lannoy (FR)

(73) Assignee: E.C.L., Ronchin (FR)

( * ) Notice: Subject to any disclaimer, the term of this patent is extended or adjusted under 35 U.S.C. 154(b) by 1417 days.

(21) Appl. No.: 11/059,301

(22) Filed: Feb. 17, 2005

(65) Prior Publication Data

US 2005/0211552 A1 Sep. 29, 2005

Related U.S. Application Data

(60) Provisional application No. 60/555,960, filed on Mar. 25, 2004.

(30) Foreign Application Priority Data

Mar. 25, 2004 (FR) ..... 04 03080

(51) Int. Cl.
*C25C 7/06* (2006.01)
*C25C 7/00* (2006.01)
*C25C 3/14* (2006.01)

(52) U.S. Cl. ..... 204/279; 205/389

(58) Field of Classification Search ..... 205/389
See application file for complete search history.

(56) References Cited

U.S. PATENT DOCUMENTS 4,053,384 A 10/1977 Siegmund
4,119,505 A * 10/1978 Baillot et al. ..... 205/389
4,855,031 A * 8/1989 Zannini ..... 204/225
6,090,264 A * 7/2000 Piron ..... 205/389
6,319,388 B1 * 11/2001 Piron et al. ..... 205/389

FOREIGN PATENT DOCUMENTS

AU 198937968 * 1/1990
NL 8801742 2/1990
UA 51731 12/2002

* cited by examiner

*Primary Examiner*—Harry D Wilkins, III
(74) *Attorney, Agent, or Firm*—Dennison, Schultz & MacDonald

(57) ABSTRACT

A tending module (7) for a series of electrolytic cells (2) to be used for the production of aluminum by fused bath electrolysis including a frame (8) that can be fixed to a trolley (6) and a turret (9) fitted on the frame (8) so as to pivot about a vertical axis A, and equipped with a set of tools including a crust breaker (11), a bucket shovel (12), at least one first anode clamp (13) and a hopper (15) fitted with a retractable duct (16), and a balcony or a cab (18) having controls that will be used to maneuver the module and the tools, and a control station (19) from which an operator can actuate the controls. The module according to the invention is characterized in that, taking a first plane P1 and a second plane P2 perpendicular to each other and to the turret (9) plane Pt and intersecting on the A axis, the center C of the control station (19) is located at a determined distance C1 from plane P1 and a determined distance C2 from plane P2, the center of the bucket shovel (12) and the center of the first anode clamp (13) are located on the opposite side of the plane P1 from the control station (19), and the crust breaker (11) and the retractable duct (16) are located between the control station (19) and the row formed by the bucket shovel (12) and the first anode clamp (13).

18 Claims, 6 Drawing Sheets

COMPACT SERVICE MODULE FOR USE IN ELECTROLYTIC ALUMINUM PRODUCTION PLANTS

This application claims the benefit of U.S. Provisional Application Ser. No. 60/555,960 filed Mar. 25, 2004.

FIELD OF THE INVENTION

The invention relates to the production of aluminum by fused bath electrolysis according to the Hall-Héroult process. More particularly, it relates to tending modules used in aluminum production plants.

DESCRIPTION OF RELATED ART

Aluminum is produced industrially by fused bath electrolysis, using the well-known Hall-Héroult process in electrolytic cells. Plants contain a large number of electrolytic cells arranged in line in buildings called electrolysis halls or rooms, and electrically connected in series using connecting conductors so as to optimize the floor occupancy of the plants. The cells are usually arranged so as to form two or several parallel lines that are electrically connected to each other by end conductors.

During operation, an electrolysis plant requires action on electrolytic cells particularly including the replacement of spent anodes by new anodes, tapping of liquid metal from cells and drawing off or adding electrolyte. The most modern plants are equipped with one or several pot tending assemblies to carry out this work, comprising a traveling crane that can be moved above the electrolytic cells and along the rows of cells, and one or several pot tending machines, each comprising a trolley and a tending module comprising handling and working devices (often called "tools") such as shovels and pulley blocks, that can be moved on the traveling crane. These pot tending assemblies are often called Pot Tending Assemblies (PTA) or Pot Tending Machines (PTM).

In order to optimize the space in electrolysis rooms and to reduce investment costs, electrolytic cells are arranged as close as possible to each other and close to one of the sides of the electrolysis rooms and with the narrowest possible circulation aisle formed adjacent to the other side of the rooms. This arrangement means that the distance between the walls in the electrolysis room and the limits of the working area of each pot tending machine tool must be as small as possible, to particularly enable access to electrolytic cells. This distance is called the "tool approach". The position of cells in the electrolysis room and the total resulting area of the hall depend very much on the volume occupied by the pot tending machines and possibilities for bringing tools close and moving them. Known tending modules occupy a large volume that prevents bringing the tools very close to the sides of the electrolysis rooms, particularly at the lateral sides, which substantially limits their movements close to these sides. Considering the large number of tools necessary for cell maintenance, it is difficult to reduce the volume of modules simply by bringing tools closer without reducing visibility of operations to operators working in control stations.

Therefore, the applicant searched for pot tending assemblies capable of avoiding these disadvantages.

SUMMARY OF THE INVENTION

An object of the invention is a tending module for a series of electrolytic cells intended for production of aluminum by fused bath electrolysis including a frame that can be fixed to a trolley and a turret fitted on the frame so as to pivot about a vertical axis A during use, defining a substantially horizontal plane during use, called the "turret plane" Pt, and equipped with:

- a set of tools particularly including a crust breaker fitted on a telescopic arm, a bucket shovel fitted on a telescopic arm, at least one first anode clamp fitted on a telescopic arm and a hopper fitted with a retractable duct;
- a balcony or a cab comprising controls that are designed to maneuver the module and the said tools and a control station from which an operator can actuate the said controls, and characterized in that, taking a first plane P1 and a second plane P2, perpendicular to each other and to the turret plane Pt and intersecting on the A axis, as a reference:
- the center C of the control station is located at a determined distance C1 from plane P1 and a determined distance C2 from plane P2;
- the center of the bucket shovel and the center of the first anode clamp are located on the opposite side of the plane P1 from the control station;
- the crust breaker and the retractable duct are located between the control station and the row formed by the bucket shovel and the first anode clamp.

The layout of the tools in the module according to the invention enables their active part to be located in a zone remote from the operator's cab and station and thus provides good visibility within the operating range of the tools. It also enables bringing them close to the axis of rotation of the turret without reducing visibility, which increases the compactness of the module and facilitates small approaches. Thus, the tending module comprises at least four basic tools used for anode changes, but remains compact.

The invention also makes it possible for the operations to be symmetric, such that a pot tending machine equipped with a module according to the invention can be used indifferently regardless of the position of the cells with respect to the lateral sides of the electrolysis room.

The invention also avoids the need to use two or several concentric turrets, which makes it possible to simplify the design of the tending module.

Another object of the invention is a pot tending machine comprising a trolley and a tending module like the one described above.

Another object of the invention is a pot tending assembly for an aluminum production plant by fused bath electrolysis comprising a traveling crane and at least one pot tending machine according to the invention.

Another object of the invention is the use of a pot tending assembly according to the invention for work on electrolytic cells designed for production of aluminum by fused bath electrolysis.

Another object of the invention is a method of changing an anode of an electrolytic cell designed for production of aluminum by fused bath electrolysis, wherein at least one determined anode is replaced by a new anode using a tending module according to the invention.

BRIEF DESCRIPTION OF THE DRAWINGS

The invention is described in detail below using the appended figures.

DESCRIPTION OF THE PREFERRED EMBODIMENTS

Figure 1:
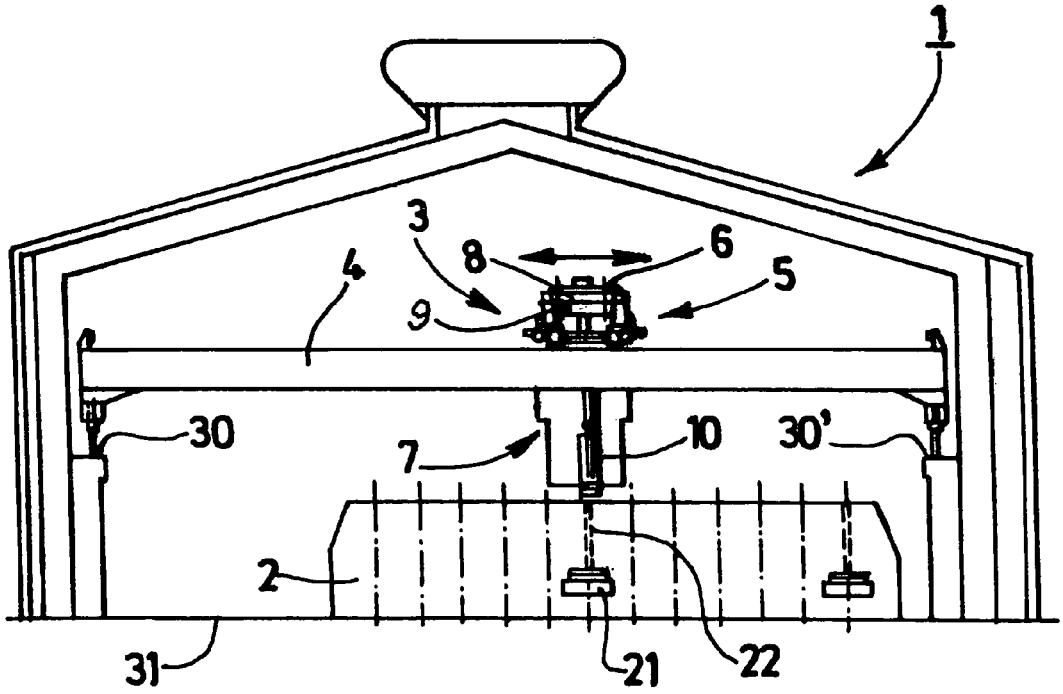
FIG. 1 shows a sectional view illustrating a typical electrolysis room that is intended for the production of aluminum and comprises a pot tending assembly shown diagrammatically.

Electrolysis plants intended for aluminum production comprise a liquid aluminum production zone that comprises one or several electrolysis rooms (1). As illustrated in FIG. 1, each electrolysis room (1) comprises electrolytic cells (2) and at least one "pot tending assembly" or "pot tending machine" (3). The electrolytic cells (2) are normally arranged in rows or lines, each row or line typically comprising more than a hundred cells. The cells (2) are arranged so as to leave a circulation aisle (31) clear along the electrolysis room (1). The cells (2) comprise a series of anodes (21) fitted with a metallic stem (22) that will be used for the attachment and electrical connection of anodes to a metallic anode frame (not illustrated).

The pot tending assembly (3) is used to perform operations on cells (2) such as anode changes or filling of feed hoppers of electrolytic cells with crushed bath and $AlF_3$. It can also be used for handling various loads such as pot elements, liquid metal ladles or anodes. The invention particularly relates to pot tending assemblies that can be used to make anode changes.

The pot tending assembly (3) comprises a traveling crane (4) that can be moved above the electrolytic cells (2), and a pot tending machine (5) comprising a mobile trolley (6) free to move on the traveling crane (4) and a tending module (7) equipped with several handling and working devices (10), such as tools (shovels, anode clamps, crust breakers, etc.). The traveling crane (4) is supported on and moves along running rails (30, 30') arranged parallel to each other and to the main axis of the hall (and the line of cells). The traveling crane (4) may thus be moved along the electrolysis room (1).

In the context of the invention, the tending module (7) comprises a frame (8), typically a platform that can be fixed to a trolley (6) and a turret (9) fitted on the frame (8) so that it can pivot around a vertical axis A during use. The turret (9) is fitted with a balcony or a control cab (18) comprising controls provided to maneuver the module (7) and the said tools (10) and a control station (19) from which an operator can actuate the said controls.

The turret (9) according to the invention is also equipped with a determined set of tools (10), namely at least one crust breaker (11) fitted on a telescopic arm (11*a*), a bucket shovel (12) installed on a telescopic arm (12*a*), at least one anode handling clamp (called "anode clamp" in the remainder of this presentation) (13, 14) fitted on a telescopic arm (13*a*, 14*a*), and a hopper (15) provided with a retractable duct (16). These tools (11 to 16) are designed for use in anode changing operations for electrolytic cells in the hall. In these operations, the crust breaker (11) is used to break the alumina and solidified bath crust that usually covers the cell anodes; the bucket shovel (12) is used to clear the anode location, after the spent anode has been withdrawn, by removing solid matter (such as pieces of crust and carbon and alumina) located in it; the anode clamp(s) (13, 14) is (are) used to grip and handle anodes by their stem, particularly for removing spent anodes from an electrolytic cell and for placement of new anodes in the electrolytic cell; the retractable duct (16) is used to add alumina and/or crushed bath in the electrolytic cell, so as to reform a coating layer, after placement of a new anode. The turret (9) according to the invention may also be equipped with supplementary tools such as a pulley block.

Within the framework of the invention, a telescopic arm (11*a*, 12*a*, 13*a*, 14*a*) comprises at least one fixed member and a first mobile member capable of being translated with respect to the fixed member along a determined translation axis. The fixed and mobile members have a substantially elongated shape, such as rod, a stock or shaft or a more complex shape, to which a principal axis can be ascribed lengthwise. The principal axis of the fixed and mobile members is typically substantially vertical in use. The determined translation axis is usually parallel to the principal axis of the fixed member and may coincide with it. The fixed member is rigidly or flexibly fixed to the turret (9). A flexible fixation allows small swings of the mobile member about the fixing point. The tools are fixed to the mobile member, usually at its end. For example, the fixed member may be a first hollow shaft with a substantially square cross section and the mobile member may be a second shaft with a substantially square cross section capable of sliding inside the first shaft; in this example, the principal axis of the first and second shafts coincide. The telescopic arm may comprise one or several intermediate mobile members located between the fixed member and the first mobile member and capable of being translated with respect to the fixed and first mobile members.

Figure 2:
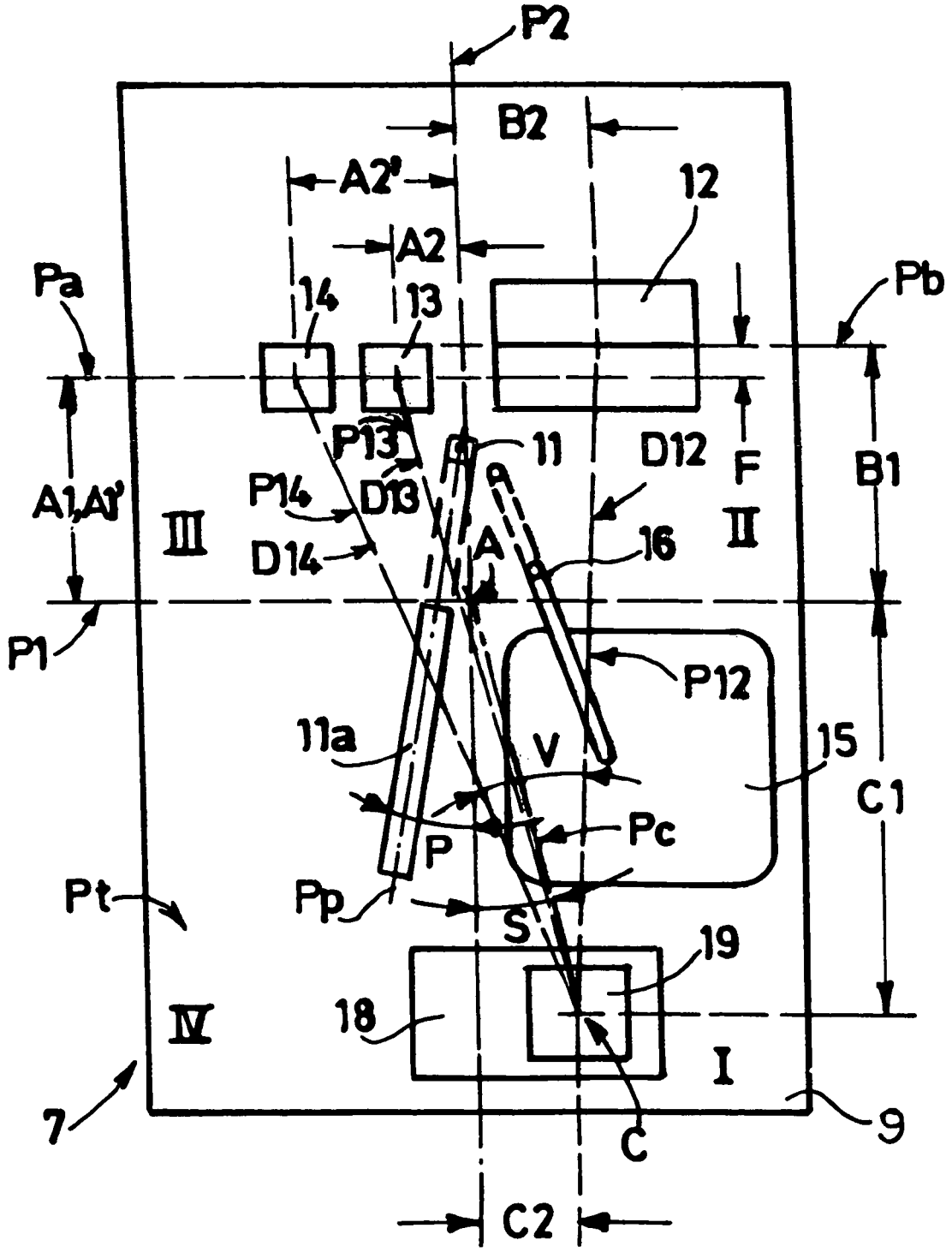
FIGS. 2 and 3 diagrammatically show a bottom view of arrangements of basic tools for the tending module according to the invention.
Figure 3:
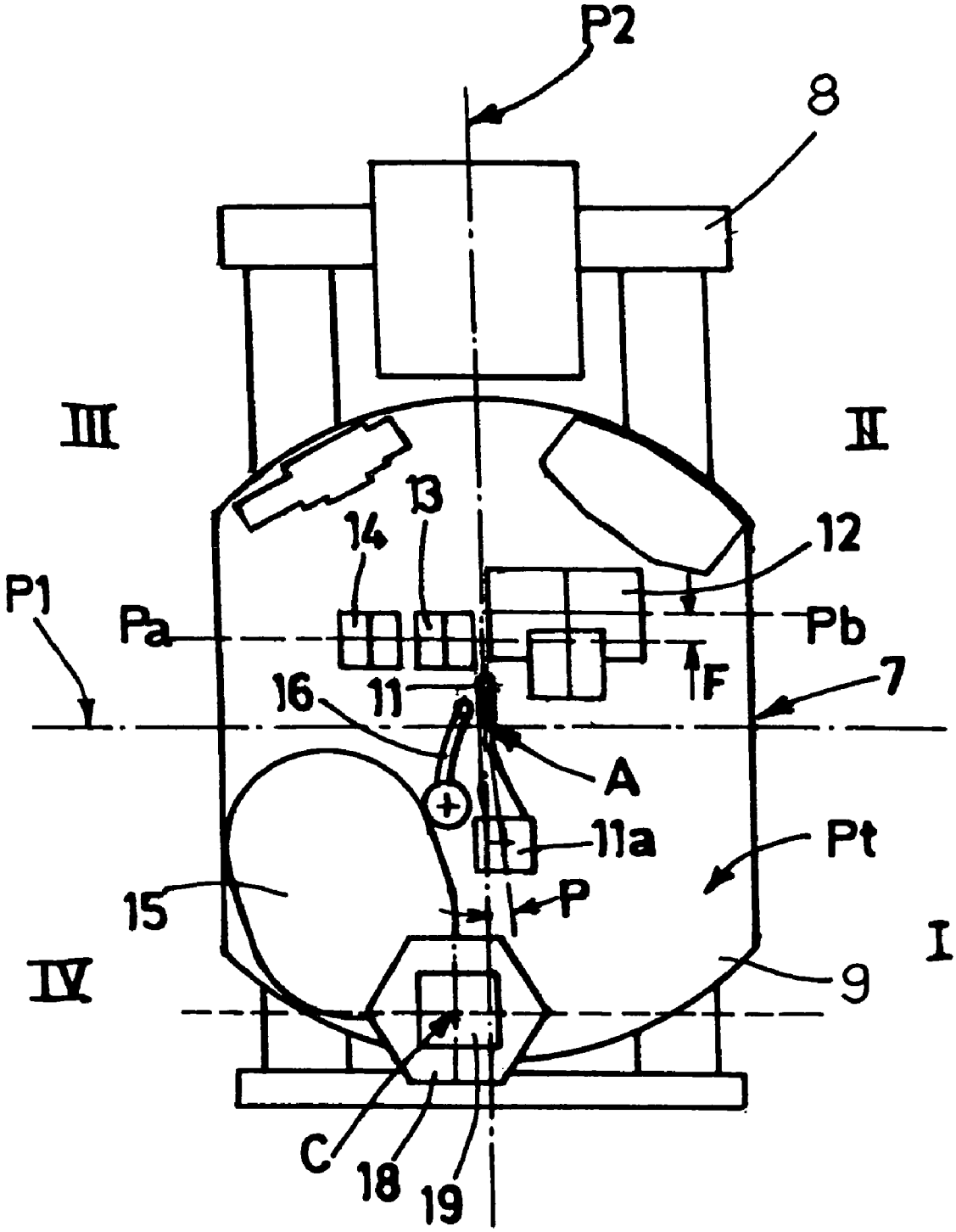

The turret (9) defines a plane Pt perpendicular to the axis A, and therefore substantially horizontal during use, called the turret plane. In order to describe the arrangement of elements on the turret, this plane is broken down into four geometric quadrants delimited by two planes (P1, P2), perpendicular to the plane of the turret (and therefore vertical in use), perpendicular to each other and passing through the axis A. This coordinate system is illustrated in FIGS. 2 and 3. The space is then broken down into four subspaces each corresponding to one of the four quadrants delimited by the two planes P1 and P2. The quadrants and the corresponding subspaces are denoted by the Roman numbers I to IV for the needs of this description.

Tools are normally all located on the same side of the turret plane, namely the side under this plane (and therefore under the frame of the turret) during use.

Using the coordinate system mentioned above:

- the center of the control station (19) is located either in the subspace reference (I or IV) located on one side of the plane P1, or on the plane P2 that separates these two subspaces;
- the center of the bucket shovel (12) and the center of the anode clamp(s) (13, 14) are located on the side opposite the plane P1, either in a subspace adjacent to the reference subspace (for example in subspace II when the center of the control station is in the subspace I), or in the subspace opposite to the reference subspace (for example in subspace III when the center of the control station is in subspace I);
- the crust breaker (11) and the retractable duct (16) are located between the control station (18) and either the plane Pa parallel to plane P1 passing through the center of the first anode clamp (13), or the plane Pb parallel to the plane P1 and passing through the center of the bucket shovel (12), depending on the space available left by the bucket shovel and the anode clamp(s). The crust breaker (11) and the retractable duct (16) are then arranged between the control station (18) and the row formed by the bucket shovel (12) and the anode clamp(s) (13, 14).

For example, the crust breaker (11) may be placed between the control station (19) and the bucket shovel (12) and the retractable duct (16) may be placed between the control station (19) and the anode clamp(s) (13, 14). The crust breaker (11) and the retractable duct (16) are preferably located between the plane P1 and the said row, and more generally between the plane P1 and the row formed by the bucket shovel (12) and the anode clamps (13, 14). The crust breaker (11) and the retractable duct (16) are preferably also located between the plane P12 parallel to the axis A and passing through the center of the control station (19) and the center of the bucket shovel (12) and the plane P13 or P14 parallel to the axis A and passing through the center of the control station (19) and the center of the anode clamp (13 or 14) that is farthest from the center of the bucket shovel.

Figure 6:
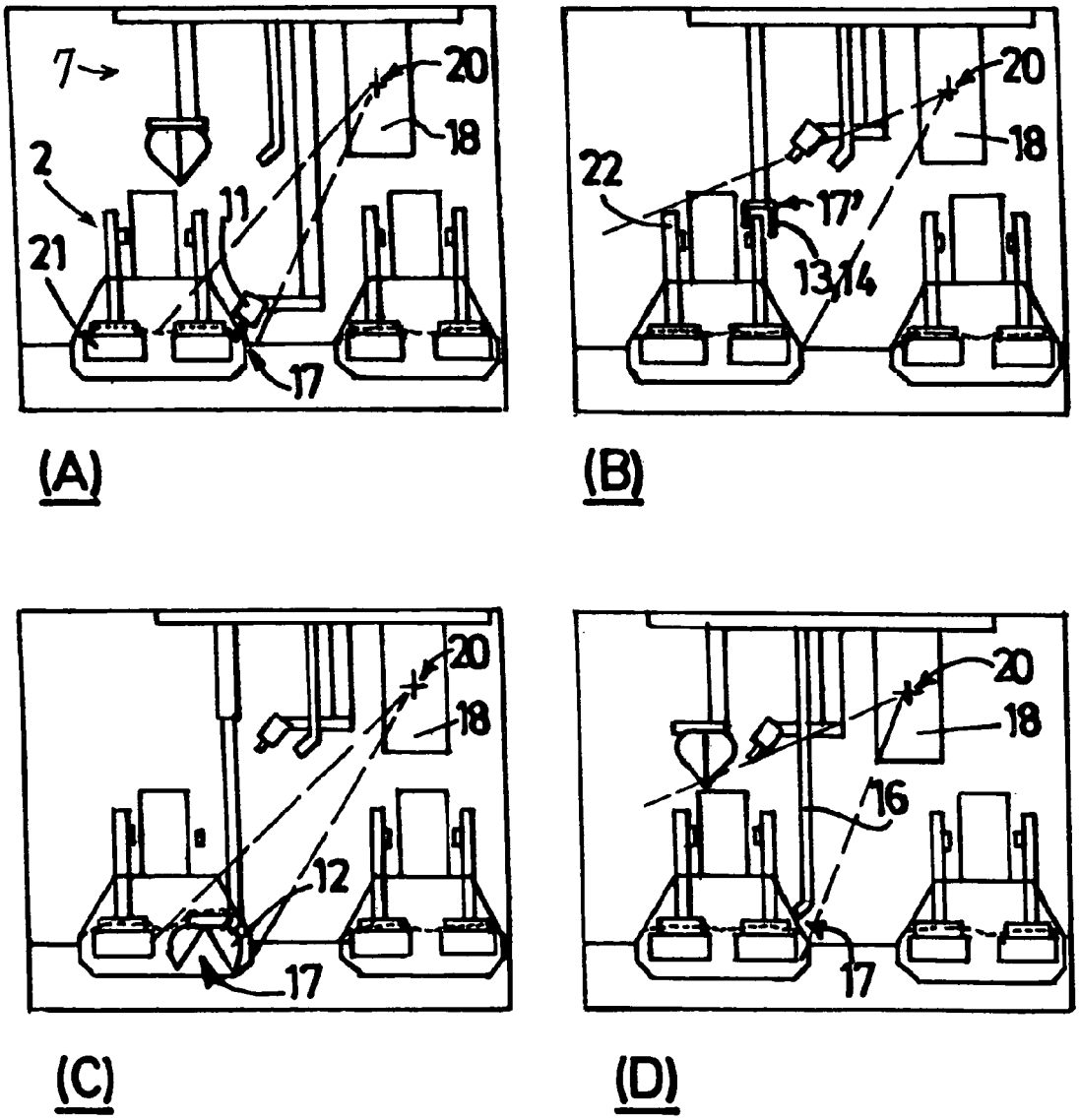
FIG. 6 illustrates anode change operations that can be performed with a module according to the invention.

As illustrated in FIG. 6, the position of the tools according to the invention provides visibility on all anode change tools (11 to 16) when the operator works in the working area (17) at the level of the pot or in the working area (17') at the level of the anode stem attachments (22). The view point of the operator on anode change operations is denoted as reference 20. These operations take place as follows: the crust that covers the anodes is firstly broken using the crust breaker (11) (FIG. 6(A)), the spent anode is then withdrawn using an anode clamp (13, 14) (FIG. 6(B)), the anode location is cleared using the bucket shovel (12) (FIG. 6(C)), and the new anode is placed using an anode clamp (13, 14) (FIG. 6(B)) and covered with alumina and/or crushed bath using the retractable duct (FIG. 6(D)). When the module is equipped with several anode clamps, these operations may be effected on several anodes simultaneously. The position of the tools according to the invention also allows said operations to be effected without requiring rotation of the turret (9) around the A axis; the positioning of the tools with respect to the location of an anode (21) or its stem (22) during said operations only requires slight displacements of the turret (9) through horizontal translation and/or slight swivelling of the turret (9) with respect to axis A.

The control station (19), the bucket shovel (12) and the anode clamp(s) (13, 14)) are located at determined radial distances from axis A. These distances may be given in terms of distances from the P1 and P2 planes as indicated in FIG. 2 (namely C1 and C2 for control station, B1 and B2 for the bucket shovel, A1 and A2 for the first anode clamp, A1' and A2' for the second anode clamp if there is one, etc.). Distances from plane P1 (A1, A1', B1, C1) depend particularly on the size of tools, the height of the traveling crane (4), dimensions of cells (2) and the distance that separates them.

The angle S between plane P2 and plane Pc passing through the axis A and the center C of the control station (19) is preferably between 0 and 40°, and more preferably between 0 and 15°. This arrangement makes it possible to put the operator's field of view between the telescopic arm (11*a*) of the crust breaker and the retractable duct (16), which is typically actuated by a telescopic arm, while maintaining the possibility of keeping these components close to plane P2. In this configuration, the determined distance C2 of the control station (19) is typically between 0 and 1000 mm, and more typically between 100 and 600 mm.

The bucket shovel (12) and the first anode clamp (13) are spaced so as to release sufficient space between them to prevent them from colliding.

Preferably, the center of the bucket shovel (12) and the center of the first anode clamp (13) are on opposite sides of the plane P2. This configuration makes it possible to make the module operate symmetrically, with a rotation of 180° around the axis A, while retaining the compactness of the module and the operator's visibility over his tools.

According to one embodiment of the invention, for which an example arrangement is diagrammatically illustrated in FIG. 2, the center C of the control station (19) and the center of the bucket shovel (12) are located on the same side of the plane P2. For example, the center C of the control station (19) may be located in subspace I and the center of the bucket shovel (12) may be located in the subspace II; the center of the first anode clamp (13) is then preferably in the subspace III. The mirror configuration about plane P2 is also possible.

According to another embodiment of the invention, for which an example arrangement is shown diagrammatically in FIG. 3, the center C of the control station (19) and the center of the first anode clamp (13) are located on the same side of the plane P2. For example, the center C of the control station (19) may be located in the subspace IV and the center of the first anode clamp (13) may be located in the subspace III; the center of the bucket shovel (12) is then preferably in subspace II. The mirror configuration about plane P2 is also possible.

The tending module (7) according to the invention may also comprise at least one additional anode clamp (14)—typically one or two additional clamps—installed on a telescopic arm and located within the same subspace as the first anode clamp (13). The center of additional anode clamp is preferably located on the same side of planes P1 and P2 as the center of the first clamp (13). Also preferably, the center of the additional anode clamp (14) is also located in the plane Pa parallel to the plane P1 and passing through the center of the first anode clamp (13).

In order to facilitate successive anode change operations, plane Pa parallel to plane P1 and passing through the center of the first anode clamp (13) and plane Pb parallel to plane P1 and passing through the center of the bucket shovel (12) are advantageously at a relatively small spacing F, that is typically between 0 and 300 mm. Thus, the telescopic arms of the bucket shovel and of the anode clamp(s) are substantially aligned, in other words they form a row of tools such that their active part is located within an area remote from the control station and thus provide very good visibility within the operating range of these tools. Furthermore, in this configuration, the operator can move from one tool to the next simply by a longitudinal displacement along the traveling crane, and a slight displacement of the crane itself.

Advantageously, the crust breaker (11) is located at a distance from plane P2 equal to between 0 and 200 mm. The angle P between plane P2 and plane Pp passing through the telescopic arm (11*a*) of the crust breaker (11) and the crust breaker (11) is preferably between 0 and 20°. Thus, the telescopic arm (11*a*) of the crust breaker (11) is located close to plane P1, or possibly in plane P1. This arrangement can simultaneously give operating symmetry of the module by a 180° rotation about axis A and module compactness. The crust breaker (11) is typically placed on an elbow arm fixed to the end of its telescopic arm (11*a*) as illustrated in FIG. 5. The telescopic arm (11*a*) of the crust breaker (11) may be vertical (FIG. 5) or inclined (FIG. 4) from the A axis.

The distance between the center of the control station (19) and the center of the bucket shovel (12) and the distance between the center of the control station (19) and the center of the anode clamp or each anode clamp (13, 14) are typically between 3 and 5 meters. These distances are center to center distances and correspond to straight-line segments D12, D13, D14 parallel to plane Pt of the turret shown in FIG. 2.

The angular opening V between the plane P2 parallel to the A axis and passing through the center of the control station (19) and the center of the bucket shovel (12) and plane P13 or P14 parallel to the A axis and passing through the center of the control station (19) and the center of the anode clamp (13, 14) farthest from the center of the shovel is preferably less than 30°, and more preferably less than 20°.

Figure 4:
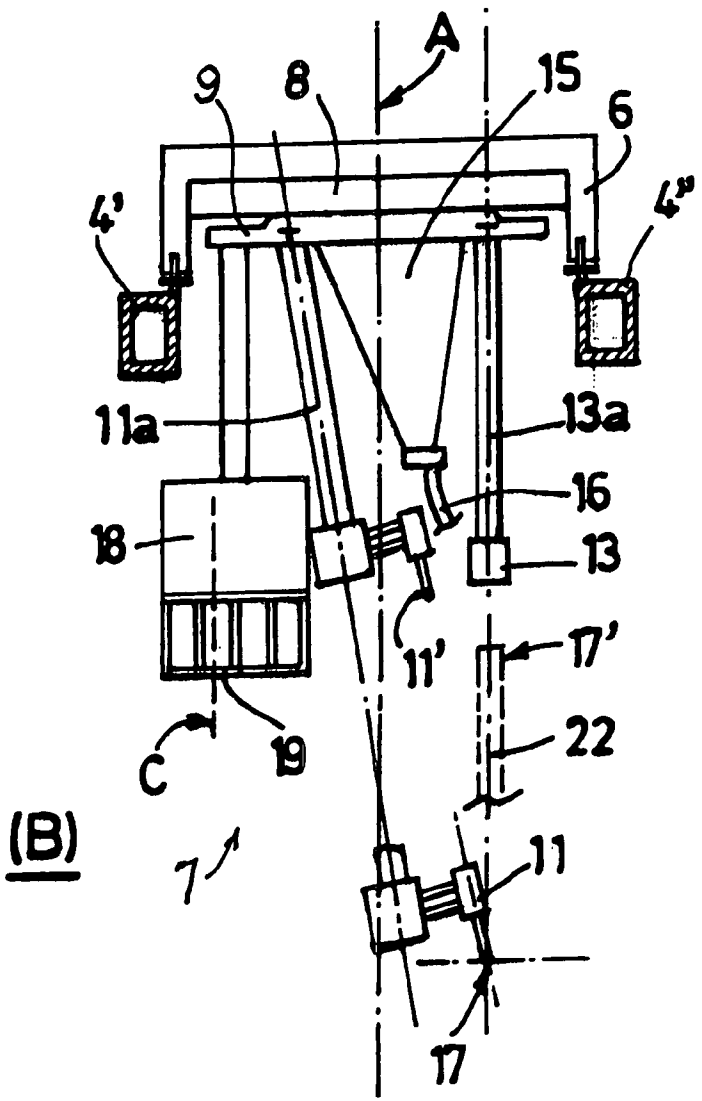
FIGS. 4 and 5 diagrammatically illustrate embodiments of the tending module according to the invention, seen in a side view.
Figure 4:
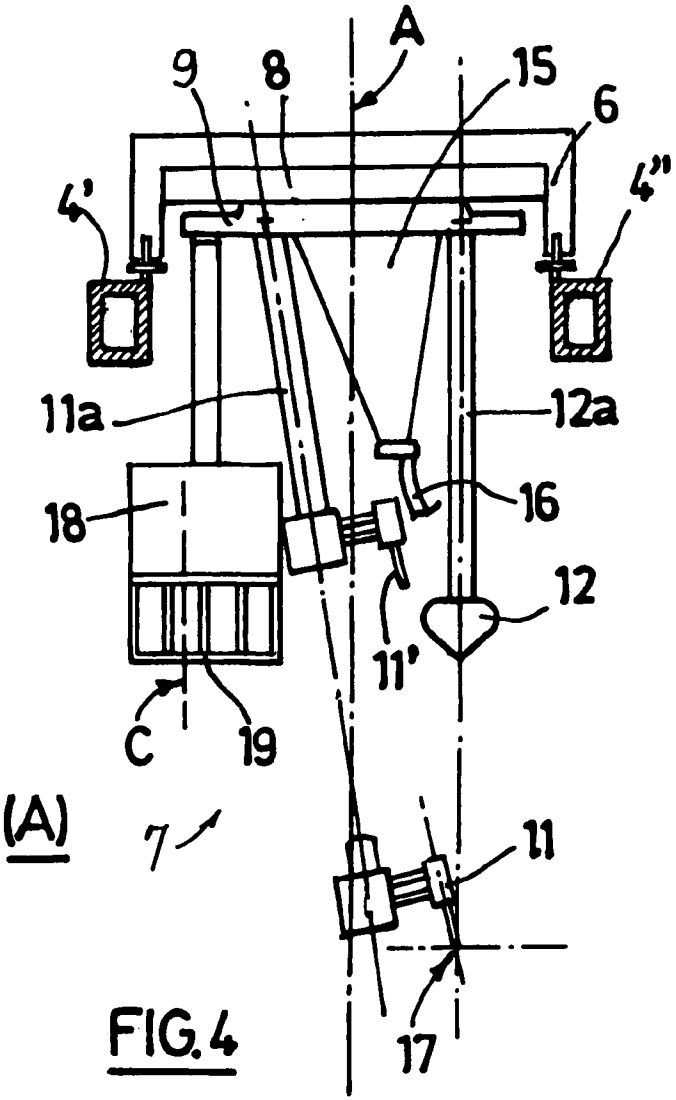
Figure 5:
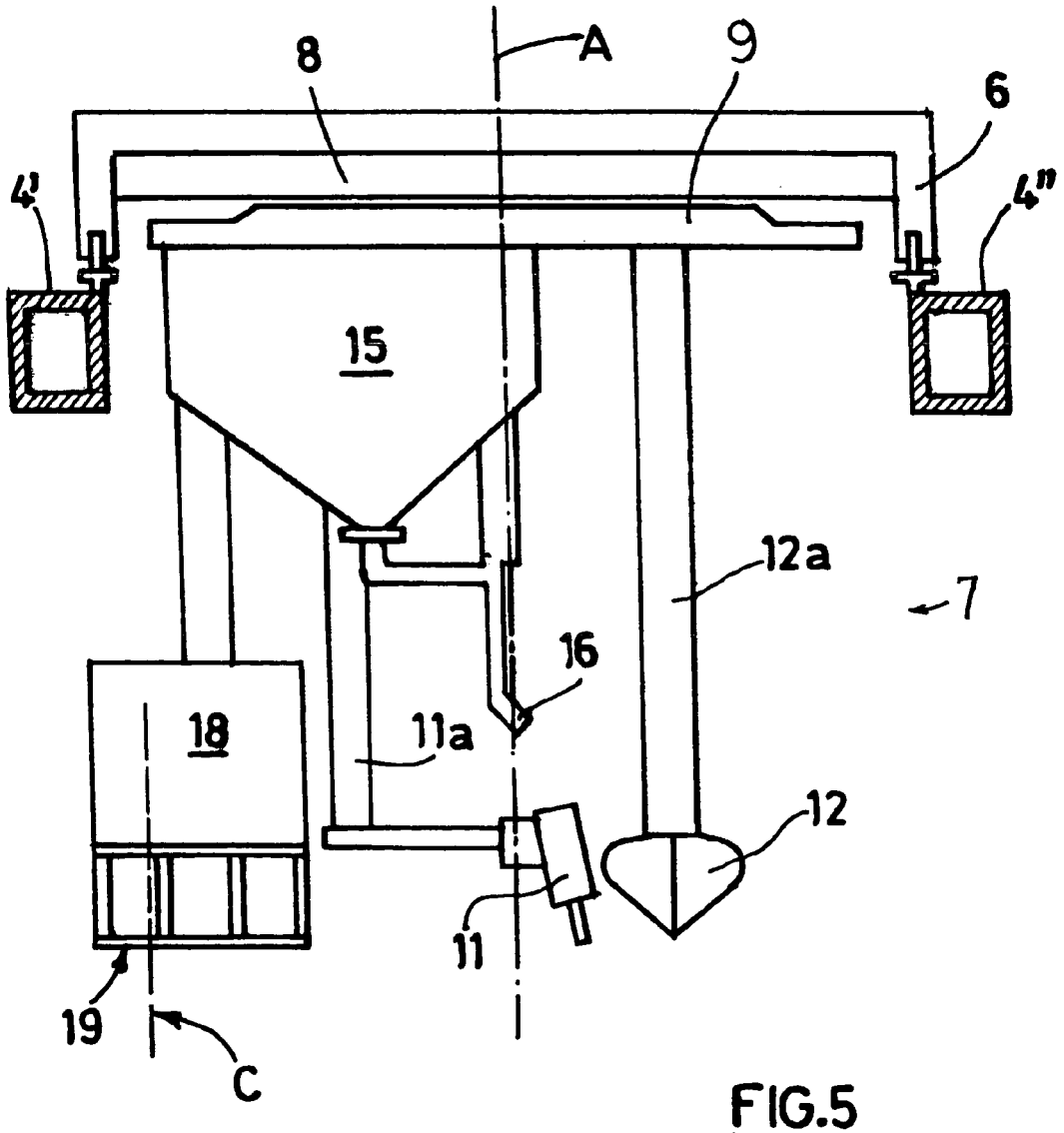

FIG. 4 illustrates a possible embodiment of the tending module according to the invention. The drawings show a side view of the module and a sectional view of the traveling crane (4); drawing 4(A) corresponds to drawing 4(B), except that the bucket shovel (12) is not shown so that the first anode clamp (13) located adjacent to it can be seen. In these drawings, the module is installed on a trolley (6) to form a pot tending machine (5). The trolley (6) is fitted on the two cross pieces (4', 4") of a crane so as to be able to move along the crane. The crust breaker is shown in a "waiting" position (11') and in a "working" position (11); in the working position, the crust breaker accesses the working area (17) of the tools. The telescopic arm (11*a*) of the crust breaker is inclined from axis A.

FIG. 5 illustrates another possible embodiment of the tending module according to the invention. The tools are shown in the waiting position. In this variant, the hopper (15) is placed closer to the cab or the balcony (18) than in the example in FIG. 4. The telescopic arm (11*a*) of the crust breaker is parallel to the A axis.

The invention is particularly advantageous for a method of changing an anode of an electrolysis cell (2) designed for the production of aluminum by fused bath electrolysis, comprising:

bringing a tending module (7) according to the invention close to said cell (2);

breaking the crust of alumina and solidified bath the surrounds and covers at least one determined used anode using the crust breaker (11);

removing the used anode using an anode clamp (13, 14);

preparing the location of the new anode using the bucket shovel (12);

placing the new anode using an anode clamp (13, 14);

covering the new anode with alumina and/or crushed bath using the retractable duct (16).

What is claimed is:

1. Tending module for a series of electrolytic cells for the production of aluminum by fused bath electrolysis, comprising:

a frame that can be fixed to a trolley, and a turret fitted on the frame so as to pivot about a vertical axis A during use, and defining, during use, a substantially horizontal turret plane Pt, the turret comprising:

a set of tools including a crust breaker fitted on a first telescopic arm, a bucket shovel fitted on a second telescopic arm, at least one anode clamp fitted on a third telescopic arm and a hopper fitted with a retractable duct; and a balcony or a cab comprising controls that are constructed and arranged to maneuver the module and the tools and a control station from which an operator can actuate the controls, wherein, taking as a reference a first plane P1 and a second plane P2 perpendicular to each other and to the turret plane Pt and intersecting on the A axis:

the control station has a center C located at a predetermined distance C1 from plane P1 and a predetermined distance C2 from plane P2;

the bucket shovel and the first anode clamp have centers which are located on the opposite side of the plane P1 from the control station;

the crust breaker and the retractable duct are located between the control station and a row formed by the bucket shovel and the first anode clamp, and the center of the bucket shovel and the center of each said at least one anode clamp are located on opposite sides of the plane P2.

2. Tending module according to claim 1, wherein the center C of the control station and the center of the bucket shovel are located on the same side of the plane P2.

3. Tending module according to claim 1, wherein the center C of the control station and the center of the at least one anode clamp are located on the same side of the plane P2.

4. Tending module according to claim 1, wherein the plane P2 and a plane Pc passing through the axis A and the center C of the control station form therebetween an angle S of between 0 and 40°.

5. Tending module according to claim 4, wherein the angle S is between 0 and 15°.

6. Tending module according to claim 1, wherein a plane Pa parallel to the plane P1 and passing through the center of the at least one anode clamp and a plane Pb parallel to the plane P1 and passing through the center of the bucket shovel are spaced by a distance F that is between 0 and 300 mm.

7. Tending module according to claim 1, wherein the crust breaker is located at a distance from plane P2 of between 0 and 200 mm.

8. Tending module according to claim 1, wherein an angle P between the plane P2 and a plane Pp passing through the telescopic arm of the crust breaker and the crust breaker is between 0 and 20°.

9. Tending module according to claim 1, wherein said at least one anode clamp comprises at least one additional anode clamp, said at least one anode clamp and said at least one additional anode clamp both having a center located on the same side of planes P1 and P2.

10. Tending module according to claim 9, wherein the center of the at least one additional anode clamp is located in a plane Pa parallel to the plane P1 and passing through the center of the first anode clamp.

11. Tending module according to claim 1, wherein an angular opening V between a plane P12 parallel to the A axis and passing through the center of the control station and the center of the bucket shovel, and a plane P13 or P14 parallel to the A axis and passing through the center of the control station and the center of an anode clamp farthest from the center of the bucket shovel, is less than 30°.

12. Tending module according to claim 11, wherein the angular opening V is less than 20°.

13. Tending module according to claim 1, wherein the crust breaker and the retractable duct are located between the plane P1 and the row formed by the bucket shovel and the at least one anode clamp.

14. Tending module according to claim 1, wherein the crust breaker and the retractable duct are located between a plane P12 parallel to the axis A and passing through the center of the control station and the center of the bucket shovel, and a plane P13 or P14 parallel to the A axis and passing through the center of the control station and the center of an anode clamp farthest from the center of the bucket shovel.

15. Pot tending machine comprising a trolley and a tending module according to claim 1.

16. Pot tending assembly in a plant for aluminum production by fused bath electrolysis, comprising a traveling crane and at least one pot tending machine according to claim 15.

17. Method of changing an anode of an electrolysis cell for the production of aluminum by fused bath electrolysis, wherein at least one predetermined anode is replaced by a new anode using a tending module according to claim 1.

18. Method of changing an anode according to claim 17, comprising the steps of:

bringing the tending module close to a cell in the row of cells;

breaking a crust of alumina and solidified bath that surrounds and covers the anode to be changed using the crust breaker;

removing the anode to be changed using the at least one anode clamp;

preparing a location for a new anode using the bucket shovel;

placing the new anode using the anode clamp; and covering the new anode with alumina and/or crushed bath using the retractable duct.

* * * * *